US011986880B2

(12) United States Patent
Nakashima

(10) Patent No.: US 11,986,880 B2
(45) Date of Patent: May 21, 2024

(54) CASTING DEVICE

(71) Applicant: Metts Corporation, Saitama (JP)

(72) Inventor: Hiroyuki Nakashima, Saitama (JP)

(73) Assignee: Metts Corporation, Saitama (JP)

( * ) Notice: Subject to any disclaimer, the term of this patent is extended or adjusted under 35 U.S.C. 154(b) by 0 days.

(21) Appl. No.: 17/594,897

(22) PCT Filed: May 18, 2020

(86) PCT No.: PCT/JP2020/019639
§ 371 (c)(1),
(2) Date: Nov. 2, 2021

(87) PCT Pub. No.: WO2020/230903
PCT Pub. Date: Nov. 19, 2020

(65) Prior Publication Data

US 2022/0193763 A1 Jun. 23, 2022

(30) Foreign Application Priority Data

May 16, 2019 (JP) ..... 2019-092929

(51) Int. Cl.
*B22D 29/04* (2006.01)
*B22C 9/06* (2006.01)
*B22D 18/06* (2006.01)

(52) U.S. Cl.
CPC ..... *B22D 29/04* (2013.01); *B22C 9/06* (2013.01); *B22D 18/06* (2013.01)

(58) Field of Classification Search
CPC ..... B22D 29/04; B22D 17/2236; B22D 18/06
See application file for complete search history.

(56) References Cited

U.S. PATENT DOCUMENTS

2013/0255901 A1 10/2013 Kim et al.
2017/0106439 A1 4/2017 Go et al.

FOREIGN PATENT DOCUMENTS

CN 102642007 A 8/2012
CN 108907142 B 10/2020
JP 2004114097 A 4/2004
JP 2006263797 A 10/2006
JP 2006334649 A 12/2006
JP 2011147981 A 8/2011
JP 2017517400 A 6/2017
(Continued)

OTHER PUBLICATIONS

International Search Report and Written Opinion pertaining to PCT/JP2020/019639; dated Aug. 18, 2020; 4 pp.
(Continued)

*Primary Examiner* — Kevin P Kerns
*Assistant Examiner* — Steven S Ha
(74) *Attorney, Agent, or Firm* — GRUMBLES LAW PLLC; Brittany Haanan

(57) ABSTRACT

An object is to provide a casting device that is capable of maintaining depressurization in a cavity. A casting device (1) is configured to move an extrusion pin (3), slidably inserted in an insertion hole (29) formed in a mold (2), into a cavity (20) in the mold to release a casted product. The casting device (1) includes a depressurized space creator (4) configured to create a depressurized space (40) on a reverse side of a cavity surface to define the cavity (20). The depressurized space creator (4) covers an opening of the insertion hole (29) to maintain depressurization in the cavity (20).

8 Claims, 4 Drawing Sheets

(56) References Cited

FOREIGN PATENT DOCUMENTS

| | | | |
|---|---|---|---|
| KR | 20100107584 | A | 10/2010 |
| KR | 20160085634 | A | 7/2016 |

OTHER PUBLICATIONS

Extended European Search Report pertaining to corresponding European Patent Application No. 20806502.9, mailed Oct. 10, 2022.

CASTING DEVICE

TECHNICAL FIELD

The present invention relates to a casting device.

BACKGROUND

In general, a casting device extrudes an extrusion pin (ejecting pin) penetrating a mold toward a cavity to release a casted product, when the casted product casted with mold is taken out. (see Patent Document 1, for example)

The extrusion pin described in the Patent Document 1 has a proximal end with a flange portion (43a) held between ejecting plates (41, 43) and has a distal end inserted through a loose-fit hole (23b) of a main mold (21) and a through hole (23) of a movable mold (20) to the cavity (C).

PRIOR ART REFERENCE

Patent Document

Patent Document 1: Japanese Patent Application Publication No. JP2011-147981 (FIGS. 1 and 2)

SUMMARY OF THE INVENTION

Problem to be Solved

In a vacuum casting mold described in Patent Document 1, when air is sucked to depressurize a cavity (C) to reduce gas or air from being entrained into a melt, the air in a recess portion (22b) enters the cavity (C) through gaps in the loose-fit hole (23b) and the through hole (23). Therefore, there has been a problem that an internal pressure in the cavity (C) is not easily decreased to maintain depressurization in the cavity (C).

In view of this, the present invention has been invented to solve the above problem and an object thereof is to provide a casting device that is capable of maintaining depressurization in a cavity.

Means to Solve Problem

To solve the above problem, a casting device according to the present invention is configured to move an extrusion pin, slidably inserted in an insertion hole formed in a mold, into a cavity in the mold to release a casted product, the casting device including a depressurized space creator configured to create a depressurized space on a reverse side of a cavity surface to define the cavity. The depressurized space creator covers an opening of the insertion hole. The "reverse side of a cavity surface" here, for example, in a mold including a fixed mold and a movable mold, refers to a side of the mold where the movable mold is arranged (rear side). In other words, the "reverse side of a cavity surface" refers to an opposite side (back side) of the movable mold to a surface of the cavity surface.

Advantageous Effects of the Invention

The present invention provides a casting device that is capable of maintaining depressurization in a cavity.

EMBODIMENTS OF THE INVENTION

Figure 1:
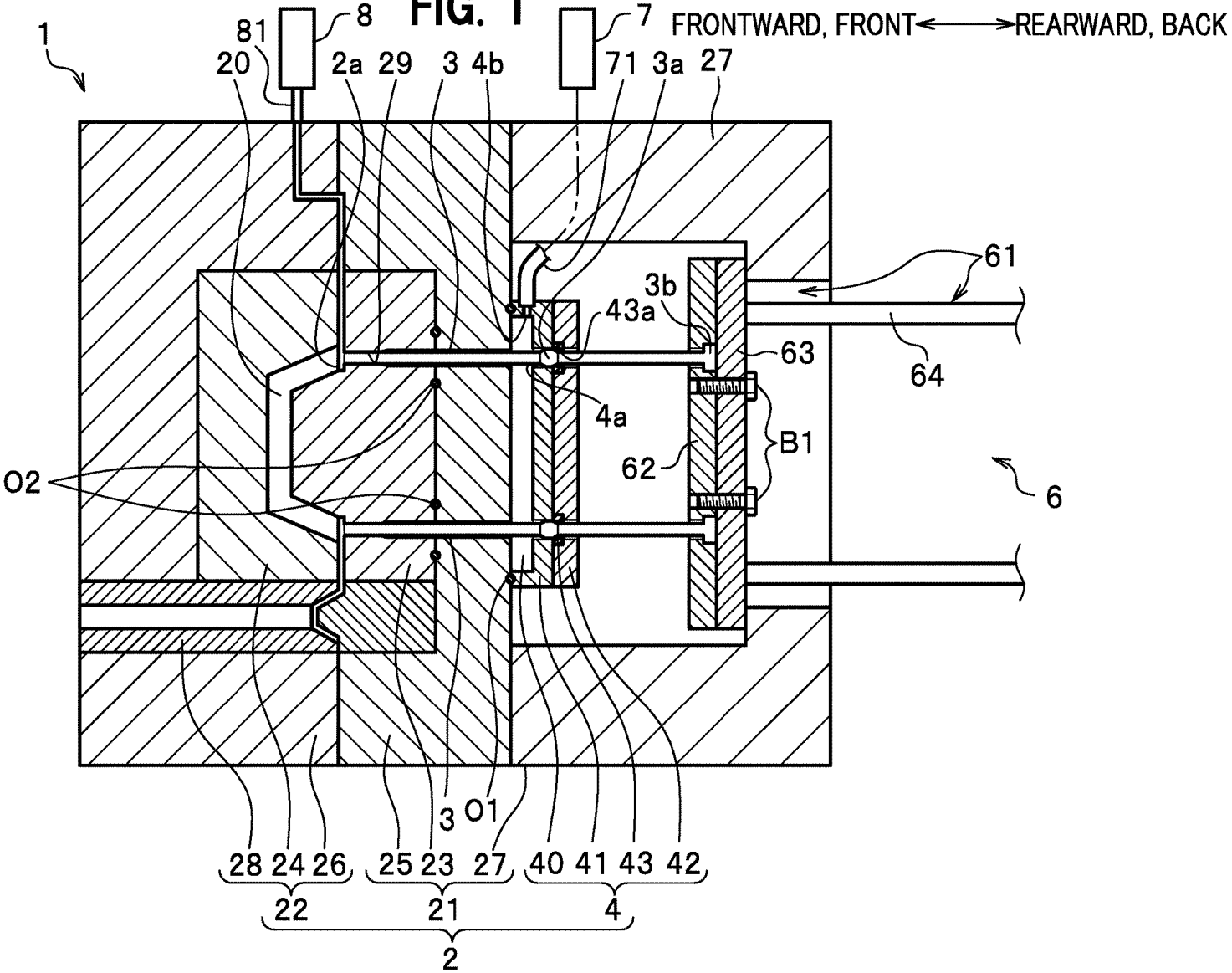
FIG. 1 is a schematic vertical cross-sectional view of a casting device according to an embodiment of the present invention.

A casting device 1 according to an embodiment of the present invention will be described with reference to FIGS. 1 and 2. Note that the casting device 1 will be described with reference to an example in which a movable mold 21 arranged on a rear side (back side of a cavity surface 2*a*) is moved in a front-rear direction (toward an obverse side or a reverse side). For convenience, the description will be made with an up-down direction and a right-left direction in the drawings as a front-rear direction and a right-left direction, respectively.

<Casting Device>

As shown in FIG. 1, the casting device 1 has a melt teemed into a cavity 20 between the movable mold 21 and a fixed mold 22 of a mold 2 and cooled, to form a casted product. After the melt is filled in the cavity 20 formed in the mold 2 to cast the casted product, the casting device 1 releases the casted product by extruding an extrusion pin 3, slidably inserted in an insertion hole 29 formed in the mold 2, into the cavity 20.

The casting device 1 mainly includes the mold 2, a plurality of the extrusion pins 3, a depressurized space creator 4 to create a depressurized space 40 on a rear side of the mold 2, a die-casting machine 6 driving the extrusion pins 3, a depressurizing device 7 to depressurize the depressurized space 40, and a depressurizing device 8 to depressurize the cavity 20. Note that the casting device 1 can be of a horizontal type in which the movable mold 21 is moved horizontally or can be of a vertical type in which the movable mold 21 is moved vertically. Hereinafter, the horizontal type casting device 1 will be described as one of examples.

<Mold>

The mold 2 is a casting mold mainly including the movable mold 21 which is movable, and the fixed mold 22 arranged to face the movable mold 21. The mold 2 can be of a horizontally split type split into multiple surfaces and a shape and a structure thereof are not particularly limited. During casting, a melt of metal such as an aluminum alloy, a magnesium alloy or a zinc alloy is fed into the cavity 20 in the mold 2 from a holding furnace (not shown) arranged in front of the mold 2 or the like. The depressurized space creator 4 to create the depressurized space 40 is arranged on the back side of the cavity surface 2*a* of the mold 2, particularly on a rear side (back side) of the insertion hole 29 in which the extrusion pin 3 is inserted.

The movable mold 21 includes a mold capable of being moved forward and backward relative to the fixed mold 22 by a forward-and-backward motion mechanism (not shown) provided in a die-casting machine 6. The movable mold 21 includes a movable mold insert 23 arranged on a side, closer to the cavity 20, of a movable main mold 25, the movable main mold 25 arranged to cover the movable mold insert 23 from behind, and a die base 27 fixed on the rear surface of the movable main mold 25. The movable mold 21 includes a core to form a rear half part of the casting product and the cavity surface 2*a*. The movable mold 21 and the movable mold insert 23 are formed with the insertion hole 29 in which the extrusion pin 3 is inserted so as to be freely movable in a front-rear direction.

The fixed mold 22 includes a front mold fixed on a die plate (not shown). The fixed mold 22 includes a fixed mold insert 24 arranged to face a front side of the movable mold insert 23, a fixed main mold 26 arranged to face a front side of the movable main mold 25, and a casting bush 28 arranged to orient frontward from an outer surface of the fixed mold insert 24. The fixed mold 22 has a fixed-mold cavity to form a front half of the casted product. The movable mold 21 has positioning keys (not shown) for aligning positions arranged on the front surface of the movable mold 21. The fixed mold 22 has recess portions (not shown) arranged on the rear surface of the fixed mold 22 to face the positioning keys. The recess portions respectively engage with the positioning keys to automatically align positions of the movable mold 21 and fixed mold 22.

<Extrusion Pin>

Figure 2:
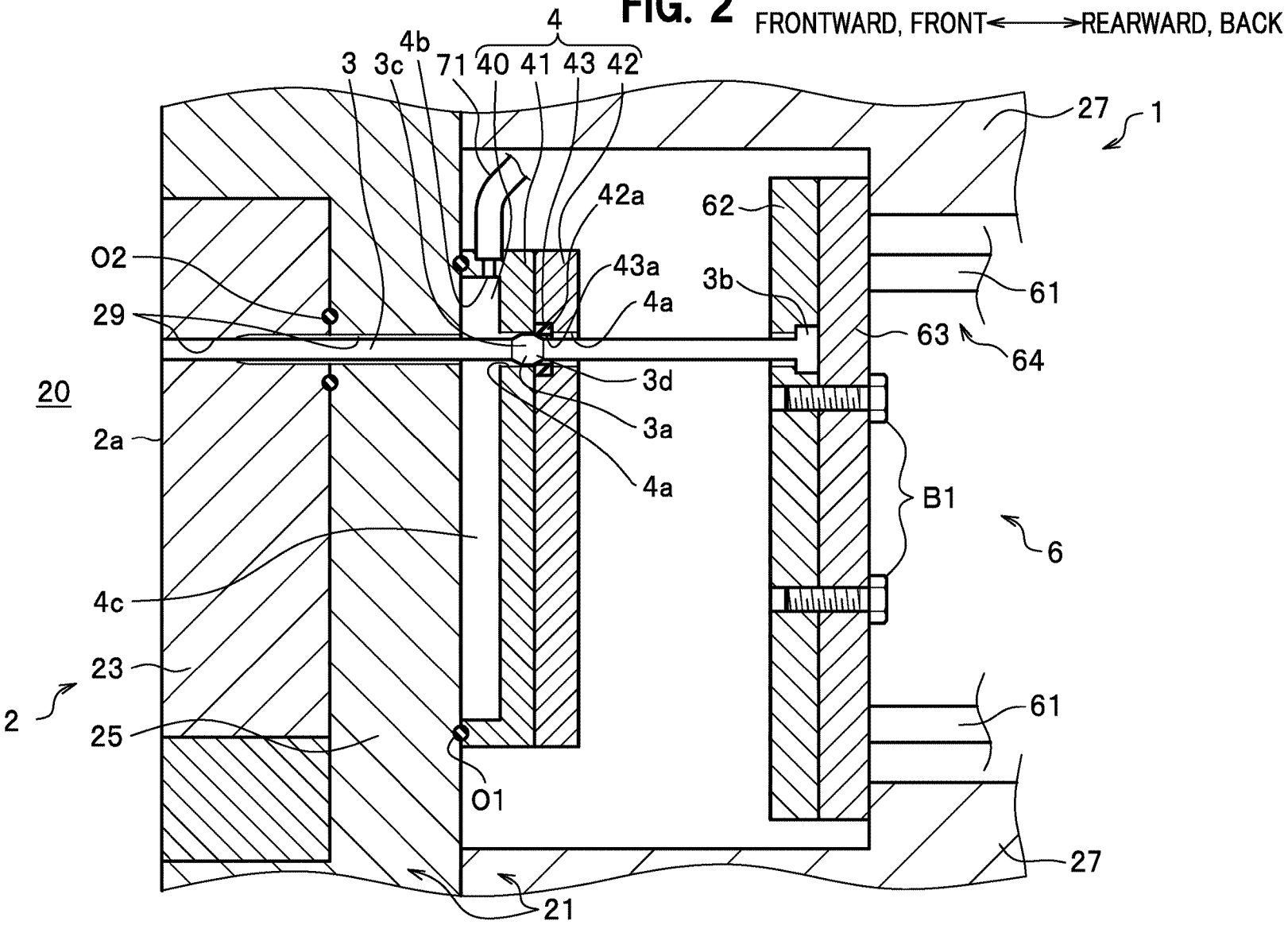
FIG. 2 is a partially enlarged schematic vertical cross-sectional view of the casting device.

The extrusion pin 3, as shown in FIG. 2, is a releasing pin in a substantially cylindrical shape (rod shape) having a flange portion 3*b* at a rear end thereof and an expanded diameter portion 3*a*, having an expanded diameter, substantially in the center thereof. The extrusion pin 3 is configured to seal the depressurized space 40 by the expanded diameter portion 3*a* while being moved rearward (backward). That is, the extrusion pin 3 closes a sealing hole 43*a* with the expanded diameter portion 3*a* pressing against a sealing member 43 while being moved backward. The extrusion pin 3 is moved in the front-rear direction by an extrusion mechanism 61. Note that many of the extrusion pins 3 are not shown in FIGS. 1 and 2, and, however, the casting device 1 is provided with 20 to 30 pins, for example.

The expanded diameter portion 3*a* includes a cylindrical sliding part 3*c* formed in a central portion and a tapered surface 3*d* formed in front of, and behind, the sliding part 3*c*. The tapered surface 3*d* of the extrusion pin 3 pushes against the sealing member 43 to close an extrusion pin insertion hole 4*a*, thereby maintaining sealing of the depressurized space 40. The flange portion 3*b* is a thick plate-shaped portion formed at the rear end of the extrusion pin 3.

<Depressurized Space Creator>

The depressurized space creator 4 is a member arranged on the rear side (reverse side) of the movable main mold 25 having the insertion hole 29 to define a sealed chamber, including the depressurized space 40 with air depressurized, behind the movable main mold 25. The depressurized space creator 4 includes a depressurized space creating member 41, a sealing member holding plate 42, the sealing member 43, a sealing member O1, and a fastening bolt (not shown).

As shown in FIG. 2, the depressurized space creating member 41 is formed with the extrusion pin insertion hole 4*a* in which the extrusion pin 3 is inserted, a suction hole 4*b* to which a suction hose 71 is connected, a recess portion 4*c* forming the depressurized space 40, and a pole part 4*d*. The depressurized space creating member 41 is fixed on the rear surface of the movable main mold 25 with the fastening bolt (not shown) via the sealing member O1.

The extrusion pin insertion hole 4*a* is a hole in which the expanded diameter portion 3*a* of the extrusion pin 3 is inserted so as to be moved freely in the front-rear direction. The extrusion pin insertion hole 4*a* is formed from the depressurized space creating member 41 to the sealing member holding plate 42, extending through the sealing member holding plate 42, on the rear side, from the front surface of the depressurized space creating member 41 in the recess portion 4*c*.

The suction hole 4*b* is a through hole to which the suction hose 71 joined to the depressurizing device 7 is attached. The suction hole 4*b* is formed to extend through a wall for the recess portion 4*c*. The recess portion 4*c* is formed of a groove which defines a space in a reversed concave shape and is recessed from the front surface of the depressurized space creating member 41. The recess portion 4*c* covers the openings of the plurality of insertion holes 29. The recess portion 4*c* is wholly continuous such that air can be sucked through the single suction hole 4*b*. The pole part (not shown) is a pole-shaped part formed in the recess portion 4*c*.

The sealing member holding plate 42 is a thick plate member fixed with the fastening bolt (not shown) via the sealing member 43 on the rear side of the depressurized space creating member 41. The sealing member holding plate 42 includes the extrusion pin insertion hole 4*a* and a sealing member mounting hole 42*a* formed at a front open end of the extrusion pin insertion hole 4*a* in the sealing member holding plate 42.

The sealing member 43 is engaged in the sealing member mounting hole 42*a* of the sealing member holding plate 42 and is made of a rubber to seal the extrusion pin insertion hole 4*a*. The sealing member 43 is formed of a tubular member having the sealing hole 43*a* in which the extrusion pin 3 is inserted.

The sealing member O1 is a member arranged between the depressurized space creating member 41 and the movable mold 21 to seal the depressurized space 40, and is formed of an annular packing such as an O ring. The sealing member O1 is arranged on a front surface of the depressurized space creating member 41, near an outer periphery of the pressurized space creating member 41. A sealing member O2 is a member arranged between the movable mold insert 23 and the movable main mold 25 to seal the circumference of the insertion hole 29, and is formed of an annular packing such as an 0 ring.

<Die-Casting Machine>

As shown in FIG. 1, the die-casting machine 6 mainly includes a forward-and-backward motion device (not shown) that moves the movable mold 21 forward and backward, and the extrusion mechanism 61 that moves the extrusion pin 3 forward and backward.

The forward-and-backward motion device (not shown) is a device positioning the movable mold 21 on the rear surface (back surface) of the fixed mold 22 to close the mold and moving the movable mold 21 rearward away from the fixed mold 22.

The extrusion mechanism 61 is a device to extrude and release a casted product in the mold 2. The extrusion mechanism 61 includes a front extrusion plate 62, a rear extrusion plate 63, a fastening bolt B1, and an extrusion mechanism coupling rod 64.

The front extrusion plate 62 is a flat plate member to engage and hold the flange portion 3*b* of the extrusion pin 3.

The rear extrusion plate 63 is a flat plate member to hold the flange portion 3*b* of the extrusion pin 3 between the front extrusion plate 62 and the rear extrusion plate 63. A plurality of the fastening bolts B1 are fixtures to fix the rear extrusion plate 63 to the front extrusion plate 62. The extrusion mechanism coupling rod 64 is a coupling rod having a front end thereof connected to the rear surface of the rear extrusion plate 63 and having a rear end thereof connected to a driving part (not shown) of the extrusion mechanism 61. The driving part (not shown) includes, for example, a hydraulic cylinder device having a piston (not shown)

<Depressurizing Device>

The depressurizing devices 7, 8 are devices to depressurize the depressurized space 40 or the cavity 20. The depressurizing device 7 includes, for example, an air pump to suck air in the depressurized space 40. The depressurizing device 8 includes, for example, an air pump to suck air in the cavity 20. The depressurizing devices 7, 8 are attached so as to communicate with the depressurized space 40 or the cavity 20 with suction hoses 71, 81.

<Holding Furnace>

The holding furnace (not shown) is a furnace to reserve a melt, such as aluminum to be teemed into the mold 2, in a heated condition.

<Operation>

Next, the operation of the casting device 1 according to the embodiment of the present invention will be described in order of casting steps, with reference to FIGS. 1 and 2.

First, as shown in FIG. 1, the movable mold 21 equipped with the movable mold insert 23 is placed and set on the rear side of the fixed mold 22 equipped with the movable mold insert 24, and the mold is closed. Thereby, the mold 2 defines the cavity 20 therein.

Next, the mold 2 is pre-heated, and then the depressurizing device 8 sucks air in the cavity 20 for depressurization, to render the cavity 20 under a negative pressure. Further, the depressurizing device 7 is driven to render the depressurized space 40 under a negative pressure. Meanwhile, the expanded diameter portion 3*a* of the extrusion pin 3 closes the extrusion pin insertion hole 4*a*. This prevents the air in the depressurized space 40 from entering the cavity 20 via a gap between the insertion hole 29 and the extrusion pin 3, resolving a problem that a pressure in the cavity 20 is not easily decreased.

Subsequently, a melt in the holding furnace (not shown) is teemed into the mold 2 to fill the cavity 20 with the melt. Meanwhile, the cavity 20 has a negative pressure, and thus the melt is easily teemed into the cavity 20. After the melt is teemed into the mold 2, the mold 2 is heated with heat of the melt conducted thereto.

Next, a temperature of the melt and mold 2 is made to reach a prescribed temperature, and then the movable mold 21 is moved backward with the forward-and-backward motion mechanism (not shown) to separate the movable mold 21 from the fixed mold 22. Consequently, the extrusion pin 3 is moved forward with the extrusion mechanism 61 to release a casted product from the fixed mold 22. This completes casting of the casted product with the casting device 1.

As described above, the present invention, as shown in FIGS. 1 and 2, provides the casting device 1 configured to move the extrusion pin 3, slidably inserted in the insertion hole 29 formed in the mold 2, into the cavity 20 in the mold 2 to release the casted product. The casting device 1 has the depressurized space creator 4 configured to create the depressurized space 40 on the reverse side of the cavity surface 2*a*. The depressurized space creator 4 covers the opening of the insertion hole 29.

As described above, the casting device 1 according to the present invention has the depressurized space creator 4 to create the depressurized space 40 on the reverse side (rear side) of the cavity surface 2*a* of the mold 2. Further, the depressurized space creator 4 covers the opening of the insertion hole 29, thereby achieving depressurization of a portion, on the back side, of the insertion hole 29, in which the extrusion pin 3 is inserted. Thus, the depressurized space creator 4 prevents the air in the depressurized space 40 from entering the cavity 20 via the insertion hole 29, thereby maintaining depressurization in a cavity. As a result, this reduces gas or air from being entrained into the melt in the cavity 20.

Further, as shown in FIG. 2, the depressurized space creator 4 has the extrusion pin insertion hole 4*a*, through which the extrusion pin 3 extending from the insertion hole 29 is inserted, and is arranged with the sealing member 43 having the sealing hole 43*a* through which the extrusion pin 3 is inserted. The extrusion pin 3 has the expanded diameter portion 3*a* having an expanded diameter, and when moved backward in the rear direction, the diameter expansion part 3*a* makes the depressurized space 40 sealed.

Consequently, when the extrusion pin 3 is moved backward, the expanded diameter portion 3*a* makes the depressurized space 40 sealed, thereby preventing ambient air from entering the depressurized space 40 via the extrusion pin insertion hole 4*a* in which the extrusion pin 3 is inserted. Also, a negative pressure in the depressurized space 40 is maintained, thereby preventing the air in the depressurized space 40 from entering the cavity 20 via the insertion hole 29. This decreases a pressure difference between the pressure in the depressurized space 40 and that in the cavity 20.

Further, as shown in FIG. 2, the sealing member 43 is formed of the tubular member having the sealing hole 43*a*. When the extrusion pin 3 is moved backward, the expanded diameter portion 3*a* presses the sealing member 43 to close the sealing hole 43*a*.

The sealing member 43 is formed of the tubular member having the sealing hole 43*a*, thereby reducing the sealing member 43 in size. When the extrusion pin 3 is moved backward, the expanded diameter portion 3*a* closes the sealing hole 43*a*, to maintain sealing of the depressurized space 40.

Further, as shown in FIG. 2, the depressurized space creator 4 is formed with the suction hole 4*b* through which the air in the depressurized space 40 is sucked to depressurize the depressurized space 40. The depressurized space creator 4 is formed with the suction hole 4*b* for depressurizing the depressurized space 40, thereby rendering the depressurized space 40 under a negative pressure by sucking the air in the depressurized space 40 through the suction hole 4*b*.

<First Modification>

Figure 3:
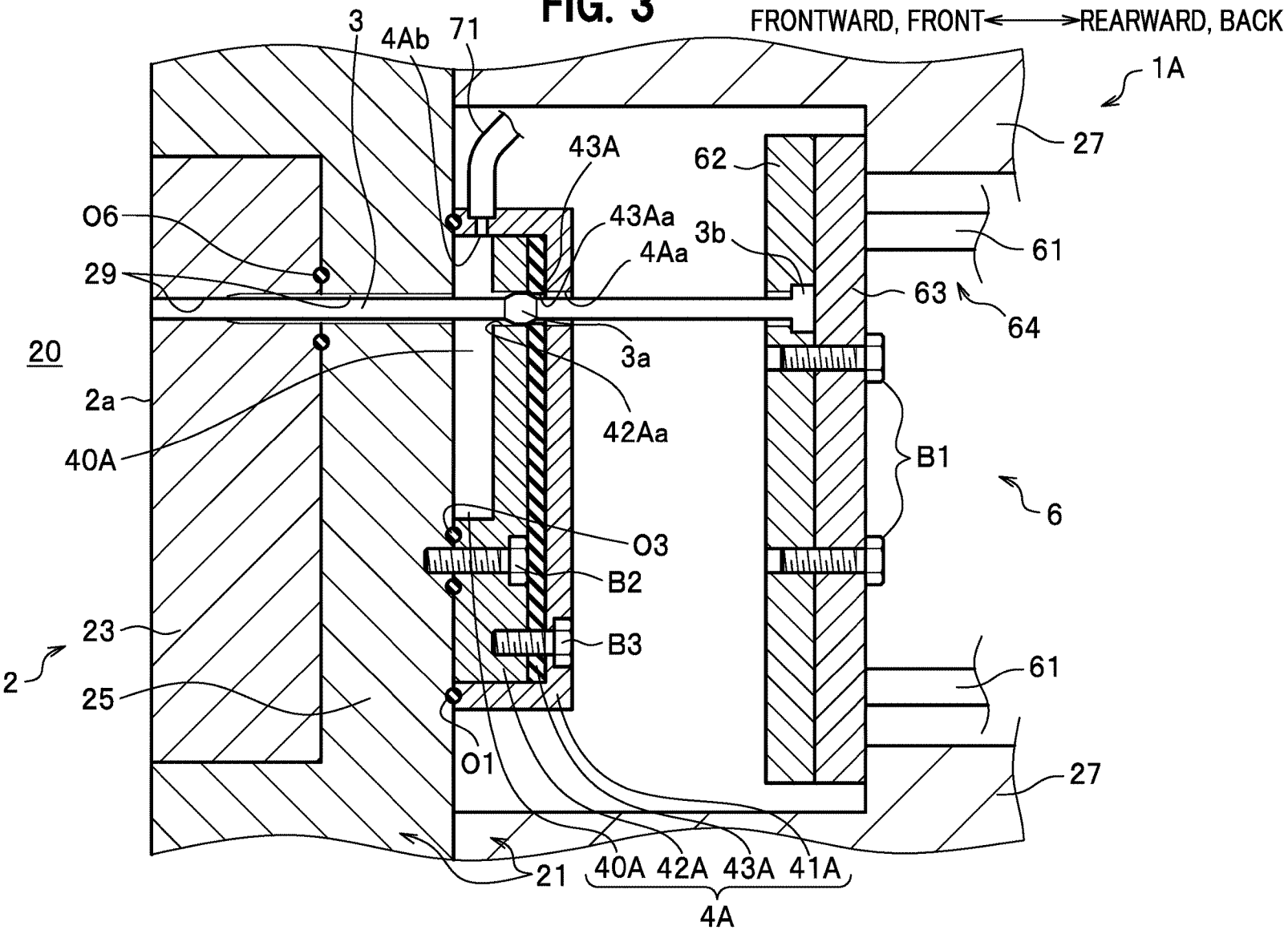
FIG. 3 is a partially enlarged schematic vertical cross-sectional view of a first modification of the casting device according to the embodiment of the present invention.

The present invention is not limited to the above-described embodiment, and various modifications and changes are possible within the scope of the technical ideas, so that it should be appreciated that the present invention also covers those modified and changed inventions. Note that the same numerals are used for the configurations already described and descriptions thereof are omitted. FIG. 3 is a partially enlarged schematic vertical cross-sectional view of a first modification of the casting device according to the embodiment of the present invention.

In the embodiment described above, as shown in FIG. 2, the depressurized space creator 4 having the tubular sealing member 43 has been described as an example, and, meanwhile, a shape of the sealing member is not limited to this shape. As shown in FIG. 3, a sealing member 43A can be formed of a single sheet member having a sealing hole 43Aa. When the extrusion pin 3 is moved backward, the expanded diameter portion 3*a* can press the sealing member 43A to seal the sealing hole 43Aa.

In this case, on a back side of the cavity surface 2*a* of the mold 2, the extrusion pins 3 are inserted and a depressurized space creator 4A to define a depressurized space 40A on a back side of the insertion hole 29 is provided. The depressurized space creator 4A has an extrusion pin insertion hole 4Aa, in which the extrusion pin 3 is inserted, and is arranged with the sealing member 43A in a plate shape having the sealing hole 43Aa, which communicates with the extrusion pin insertion hole 4Aa and in which the extrusion pin 3 is inserted.

When the extrusion pin 3 is moved backward, the expanded diameter portion 3*a* presses the sealing member 43A to close the sealing hole 43Aa and makes the depressurized space 40A sealed. A depressurized space creating member 41A has a space in a reversed concave shape, when viewed in vertical cross-section. The depressurized space creating member 41A has a sealing member holding plate 42A framed in the space in a reversed concave shape, on a ceiling surface for the space, via the sealing member 43A. The depressurized space creating member 41A is fixed to a sealing member holding plate 42A with a fastening bolt B3 via the sealing member 43A. The sealing member holding plate 42A is fixed to the movable main mold 25 with a fastening bolt B2 via sealing members O1, O3. Note that the fastening bolts B2, B3 are provided at multiple places. The sealing member O3 is provided between the movable main mold 25 and the sealing member holding plate 42A around a place where the fastening bolt B2 is provided. The sealing member O3 is formed of an annular packing such as an O ring. Further, the depressurized space creator 4A is formed with a suction hole 4Ab, to which the suction hose 71 of the depressurizing device 7 (shown in FIG. 1) is connected to suck the air in the depressurized space 40A to depressurize the depressurized space 40A.

Consequently, even when the sealing member 43A is a sheet-shaped member having the sealing hole 43Aa, the sealing member 43A maintains sealing of the extrusion pin insertion hole 4Aa, in which the extrusion pin 3 is inserted, to render the depressurized space 40A under a negative pressure.

<Second Modification>

Figure 4A:
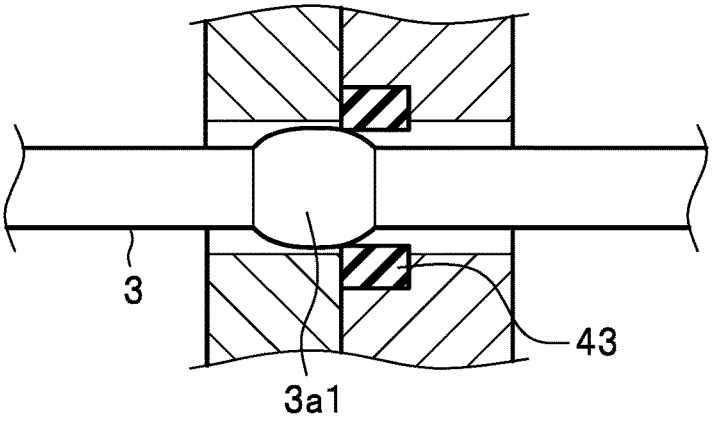
FIG. 4A is a partially enlarged schematic vertical cross-sectional view of a second modification of the casting device according to the embodiment of the present invention, showing another shape of an expanded diameter portion of an extrusion pin.
Figure 4B:
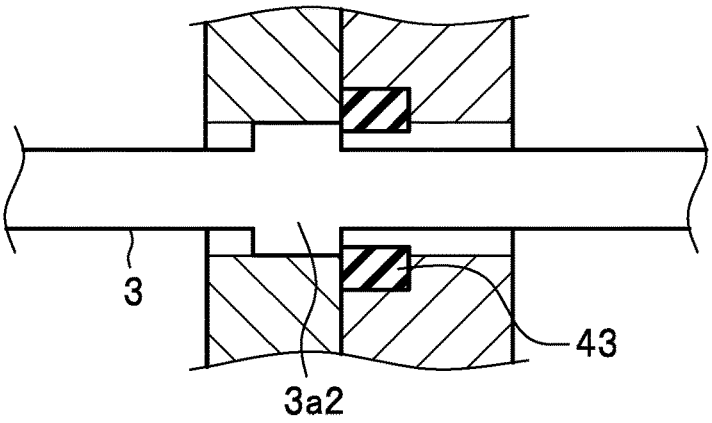
FIG. 4B is a partially enlarged schematic vertical cross-sectional view of the second modification of the casting device according to the embodiment of the present invention, showing still another shape of the expanded diameter portion.
Figure 4C:
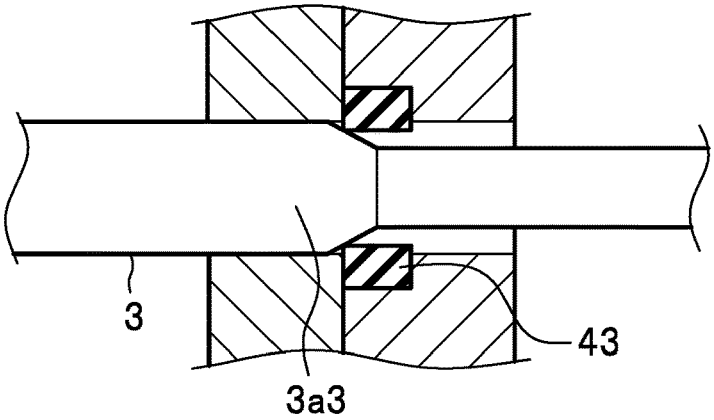
FIG. 4C is a partially enlarged schematic vertical cross-sectional view of the second modification of the casting device according to the embodiment of the present invention, showing still another shape of the expanded diameter portion.

FIGS. 4A, 4B, 4C are each a partially enlarged schematic vertical cross-sectional view of a second modification of the casting device according to the embodiment of the present invention, showing another shape of an expanded diameter portion of the extrusion pin.

The expanded diameter portion 3*a* of the extrusion pin 3 can have any shape which abuts against the sealing member 43 to seal the extrusion pin insertion hole 4*a*, and is not limited to one having the shape shown in FIG. 2.

For example, as shown in FIG. 4A, the expanded diameter portion 3*a* can be an expanded diameter portion 3*a*1 made of an annular protrusion in a semicircular shape, a curved shape, or an arc shape in cross section, as viewed from an outer periphery of the extrusion pin 3. Further, as shown in FIG. 4B, the expanded diameter portion 3*a* can be an expanded diameter portion 3*a*2 made of an annular protrusion protruding radially outward to have a flange shape in cross section, as viewed from the outer periphery of the extrusion pin 3. Further, as shown in FIG. 4C, the expanded diameter portion 3*a* can be an expanded diameter portion 3*a*3 with an outer diameter expanded in a taper shape to have a thick diameter in cross section, as viewed from the outer peripheral of the extrusion pin 3.

<Other Modifications>

In the embodiment described above, as shown in FIG. 2, the sealing member 43 having a cylindrical shape has been described as an example. Meanwhile, the shape of the sealing member 43 is not limited thereto. The sealing member 43 can be anything to seal the extrusion pin insertion hole 4*a*, and can be an O ring having a circular shape in cross section, or a packing having an oval shape or a polygonal shape, such as a quadrangle shape, in cross section.

Further, in the first modification described above, the sealing member 43A formed of the single sheet member has been described as an example, however, the number of sheets can be appropriately changed to two or more depending on an arrangement condition and the like.

LIST OF REFERENCE SIGNS

1, 1A casting devise
2 mold
2*a* cavity surface
3 extrusion pin
3*a*, 3*a*1, 3*a*2, 3*a*3 expanded diameter portion
4, 4A depressurized space creator
4*a*, 4Aa extrusion pin insertion hole
20 cavity
29 insertion hole
40, 40A depressurized space
43, 43A sealing member
43*a*, 43Aa sealing hole

What is claimed is:

1. A casting device comprising:

a mold having a cavity into which a melt is to be fed and an insertion hole communicating with the cavity;

an extrusion pin slidably inserted into the insertion hole and configured to move into the cavity to release a casted product; and a depressurized space creator configured to create a depressurized space on a reverse side of a cavity surface facing the cavity to define the cavity, wherein the depressurized space creator covers an opening of the insertion hole, wherein the depressurized space creator has an extrusion pin insertion hole, through which the extrusion pin extending from the insertion hole is inserted, wherein the depressurized space creator is arranged with a sealing member having a sealing hole which communicates with the extrusion pin insertion hole and through which the extrusion pin is inserted, wherein the extrusion pin has a radial dimension and an expanded diameter portion having a larger radial dimension than the radial dimension of the extrusion pin, wherein the radial dimension of the extrusion pin is smaller than a radial dimension of the sealing hole and the radial dimension of the expanded diameter portion is larger than the radial dimension of the sealing hole, wherein when the extrusion pin moves backward, the expanded diameter portion is configured to press the sealing member to close the sealing hole, so that the depressurized space is sealed, wherein the sealing member has an inner periphery defining the sealing hole, wherein the expanded diameter portion projects radially outward from the inner periphery of the sealing member, wherein a remainder of the extrusion pin except for the expanded diameter portion is radially inward away from the inner periphery of the sealing member.

2. The casting device according to claim 1 wherein the sealing member is formed of a tubular member having the sealing hole, and the depressurized space creator includes:

a depressurized space creating member having the extrusion pin insertion hole and creating the depressurized space; and a sealing member holding plate which has a sealing member mounting hole for mounting the sealing member and is provided behind the depressurized space creating member.

3. The casting device according to claim 1 wherein the sealing member is formed of a plate-shaped member having the sealing hole, and wherein the depressurized space creator includes:

a depressurized space creating member which has the extrusion pin insertion hole and creates the depressurized space; and a sealing member holding plate which has an expanded-diameter-portion-insertion-hole in which the expanded diameter portion is inserted and which holds the sealing member disposed on a ceiling surface of the depressurized space creating member for the depressurized space.

4. The casting device according to claim 1, wherein the depressurized space creator is formed with a suction hole through which air is sucked out of the depressurized space to depressurize the depressurized space.

5. A casting device comprising:

a mold having a cavity into which a melt is to be fed and an insertion hole communicating with the cavity;

an extrusion pin slidably inserted into the insertion hole and configured to move into the cavity to release a casted product; and a depressurized space creator configured to create a depressurized space on a reverse side of a cavity surface facing the cavity to define the cavity, wherein the depressurized space creator covers an opening of the insertion hole, wherein the depressurized space creator has an extrusion pin insertion hole, through which the extrusion pin extending from the insertion hole is inserted, wherein the depressurized space creator is arranged with a sealing member having a sealing hole which communicates with the extrusion pin insertion hole and through which the extrusion pin is inserted, wherein the sealing member is formed of a tubular member having the sealing hole, and the depressurized space creator includes:

a depressurized space creating member having the extrusion pin insertion hole and creating the depressurized space; and a sealing member holding plate which has a sealing member mounting hole for mounting the sealing member and is provided behind the depressurized space creating member.

6. The casting device according to claim 5, wherein the depressurized space creator is formed with a suction hole through which air is sucked out of the depressurized space to depressurize the depressurized space.

7. A casting device comprising:

a mold having a cavity into which a melt is to be fed and an insertion hole communicating with the cavity;

an extrusion pin slidably inserted into the insertion hole and configured to move into the cavity to release a casted product; and a depressurized space creator configured to create a depressurized space on a reverse side of a cavity surface facing the cavity to define the cavity, wherein the depressurized space creator covers an opening of the insertion hole, wherein the depressurized space creator has an extrusion pin insertion hole, through which the extrusion pin extending from the insertion hole is inserted, wherein the depressurized space creator is arranged with a sealing member having a sealing hole which communicates with the extrusion pin insertion hole and through which the extrusion pin is inserted, wherein the extrusion pin has an expanded diameter portion having an expanded diameter, and when the extrusion pin moves backward, the expanded diameter portion is configured to press the sealing member to close the sealing hole, so that the depressurized space is sealed, wherein the sealing member is formed of a plate-shaped member having the sealing hole, and wherein the depressurized space creator includes:

a depressurized space creating member which has the extrusion pin insertion hole and creates the depressurized space; and a sealing member holding plate which has an expanded-diameter-portion-insertion-hole in which the expanded diameter portion is inserted and which holds the sealing member disposed on a ceiling surface of the depressurized space creating member for the depressurized space.

8. The casting device according to claim 7, wherein the depressurized space creator is formed with a suction hole through which air is sucked out of the depressurized space to depressurize the depressurized space.

* * * * *